250-506.1
6/15/87 OR 4,673,814

United States Patent [19]
Schroeder et al.

[11] Patent Number: 4,673,814
[45] Date of Patent: Jun. 16, 1987

[54] CONTAINER FOR RECEIVING AND SAFELY STORING RADIOACTIVE MATERIALS AND METHOD FOR TIGHTLY SEALING THE SAME

[75] Inventors: Guenter Schroeder, Wetter; Guenther Dudek, Visselhoevede; Heinolf Schrader, Bruchhausen, all of Fed. Rep. of Germany

[73] Assignee: Deutsche Gesellschaft für Wiederaufarbeitung von Kernbrennstoffen mbH, Hanover, Fed. Rep. of Germany

[21] Appl. No.: 416,679

[22] Filed: Sep. 10, 1982

[30] Foreign Application Priority Data

Sep. 28, 1981 [DE] Fed. Rep. of Germany ..... 3138485

[51] Int. Cl.[4] ..... G21F 5/00
[52] U.S. Cl. ..... 250/506.1; 220/67; 220/DIG. 29
[58] Field of Search ..... 250/506.1; 220/67, DIG. 29

[56] References Cited

U.S. PATENT DOCUMENTS

| | | | |
|---|---|---|---|
| 1,105,143 | 7/1914 | Johnson | 220/DIG. 24 |
| 1,878,709 | 9/1932 | Kerr | 220/67 |
| 4,197,467 | 4/1980 | Williams | 250/506.1 |
| 4,278,892 | 7/1981 | Baatz et al. | 250/506.1 |
| 4,320,847 | 3/1982 | Gesser et al. | 250/506.1 X |

FOREIGN PATENT DOCUMENTS

| | | | |
|---|---|---|---|
| 2930991 | 2/1981 | Fed. Rep. of Germany | 250/506.1 |

OTHER PUBLICATIONS

Illustrated Encyclopedia of Science and Technology, 1979, pp. 342–343.
Nelson, et al, "Retrievable Surface Storage Facility for Commercial High-Level Waste", Dec. 1974 issue of Nuclear Technology, vol. 24, pp. 391 to 397.

*Primary Examiner*—Alfred E. Smith
*Assistant Examiner*—Jack I. Berman
*Attorney, Agent, or Firm*—Walter Ottesen

[57] ABSTRACT

The invention is directed to a container for receiving and safely storing radioactive or other materials damaging to living organisms, especially such materials as vitrified radioactive fission products or irradiated nuclear reactor fuel elements. The container includes a vessel and a sealing cover. The vessel has a circular opening at one of its ends for receiving the materials to be stored therein, and a sealing cover is seated in this opening to tightly seal the container. In order to obtain a container of the kind which has the required high impermeability to gas, the open end of the inner bore of the vessel is widened to define a conical surface. A sealing cover is pressed into the vessel at this conical surfce. The sealing cover has a peripheral surface which converges toward the interior of the vessel and which has a taper corresponding to that of the conical surface of the vessel. The vessel wall and sealing cover are welded together by means of a fused-mass joint extending around the entire periphery of the cover. By means of the conical configuration of the upper end portion of the vessel and of the sealing cover, a considerably improved seal between the vessel wall and the sealing cover is obtained. A method for sealing the container is also disclosed.

12 Claims, 2 Drawing Figures

CONTAINER FOR RECEIVING AND SAFELY STORING RADIOACTIVE MATERIALS AND METHOD FOR TIGHTLY SEALING THE SAME

FIELD OF THE INVENTION

The invention relates to a container for receiving and safely storing radioactive materials and other materials damaging to living organisms. The container is especially suited for storing vitrified radioactive fission products or irradiated nuclear reactor fuel elements. The container includes a vessel and a sealing cover. One end of the vessel is provided with a circular opening into which the sealing cover can be placed to tightly seal the container.

BACKGROUND OF THE INVENTION

Radioactive materials such as vitrified radioactive fission products or irradiated nuclear fuel elements have to be placed in special containers for the purpose of transport and storage. The containers have a high shielding to radiation and a sufficient cooling surface as well as a high stability. Metal containers guarantee a safe enclosure for radioactive waste products. The metal containers are open only at one end and it is this opening through which the materials to be stored are passed.

After filling a container destined for terminal storage with glass from highly radioactive fission products, it has been conventional practice to place a cylindrical cover in the open end of the vessel and to weld the cover to the abutting container rim. By means of the tight seal of the vessel with the sealing cover, it was believed that the radioactive materials or materials damaging to living organisms could be safely separated from the ambient.

The results obtained up until now with this procedure have been unsatisfactory. The welding activity has to be carried out in a so-called "hot cell." Accordingly, it was necessary to conduct the welding operation from a remote location with the aid of remotely-controlled apparatus. Up to now, the desired impermeability of the seal to gas of $10^{-3}$ Torr Liter/Second could not be obtained with certainty and reproducibility. The operating person carrying out the welding operation must necessarily perform each welding operation individually and always with a different quality.

SUMMARY OF THE INVENTION

It is an object of the invention to provide a container of the kind described above wherein a safe closure of the container is achieved by the sealing cover with the required impermeability to gas. It is a further object of the invention to provide method for tightly sealing the container.

The container includes a vessel and a sealing cover for closing the vessel off from the ambient. According to a feature of the invention, the open end of the inner bore of the vessel is widened to define a conical surface whereat the sealing cover is seated when pressed into the vessel, the sealing cover having an outer peripheral conical surface formed to converge toward the interior of the vessel and the outer peripheral conical surface having a taper corresponding to the taper of the conical surface of the vessel. The wall of the vessel and the sealing cover are welded together by means of a fused-mass extending about the periphery of the sealing cover.

After the vessel is filled, the conical sealing cover is pressed into the conical opening of the vessel. As the conical sealing cover is pressed into the vessel, the sealing cover exerts a radial force on the vessel wall surface so that irregularities of this surface surrounding the cover are minimized and even eliminated. The surface of the vessel wall adapts itself well to the outer peripheral surface of the sealing cover.

By means of the conical configuration of the two surfaces which are pressed against each other, namely, the conical surface of the vessel and the peripheral surface of the sealing cover, a considerable improvement in the seal between the inner wall of the vessel and the sealing cover is obtained. The conical sealing surfaces are responsible for the improvement in the seal of the connection between sealing cover and vessel. After completing the fused-mass welding operation, a safe and tight closure of the container is obtained.

In an advantageous further embodiment of the invention, the upper outer edge of the sealing cover lies beneath the rim of the vessel whereby the vessel rim and the upper edge of the sealing cover are welded together with a fillet weld extending about the periphery of the sealing cover. If the conical sealing cover is pressed so deep into the conical section of the container so that there is sufficient room between the upper edge of the sealing cover and the rim of the vessel to accommodate a fillet weld, then the required impermeability to gas and mechanical joint between the vessel and sealing cover can be obtained.

According to another feature of the invention, the upper portion of the outer peripheral surface of the cover can be bevelled so that the same diverges away from the remainder of this peripheral surface. With this short cylindrical bevel of the cover, a welding starter gap of wedge-shaped configuration is obtained between the inner wall of the vessel and the peripheral surface of the sealing cover. After pressing the sealing cover into the conical seat of the vessel, the sealing cover is welded to the vessel by means of a fused-mass weld under the application of shielding gas. In this way, the shielding gas can blow the melt into the annular wedge-shaped gap. This embodiment is especially suited for a remotely-controlled welding process which can be conducted automatically in a hot cell. The quality of the weld joint is higher than if an operating person individually conducted each welding operation. Further, the weld contemplated by this embodiment of the invention is reproducible every time.

In still a further embodiment of the invention, the sealing cover is provided with a valve accessible from the outside and which valve communicates with the interior of the vessel; this arrangement permits the valve to be connected to a test gas source. By holding the valve open, an equalization of pressure is possible during the welding process between the space defined by the sealing cover and vessel and the space surrounding the system. On the other hand, after the welding process has been terminated, a simple test of the impermeability to gas of the weld joint is possible.

A further advantageous embodiment of the invention is achieved by mounting a valve in a recess of a projection formed on the sealing cover. The recess defined by the projection constitutes a protective chamber for the valve so that the latter will not become damaged should the container be inadvertently dropped.

Another advantageous embodiment of the invention is to provide a plug for closing off the recess. The plug can, for example, be configured to threadably engage an internal thread of the recess. Where the parts are made of metal and the container receives radioactive waste materials, it is preferable to weld the plug with the projection.

According to a further embodiment of the invention, the projection can be configured as a cylinder and adapted to threadably engage the sealing cover in a centrally disposed threaded bore formed in the latter. The projection can furthermore be given the shape of a knob. This embodiment permits the operation of sealing the container to be conducted without difficulty by remotely-controlled programmed machines.

The invention also is directed to a method for tightly sealing a container for receiving and safely storing radioactive materials and other materials dangerous to living organisms especially such materials as vitrified radioactive fission products or irradiated nuclear reactor fuel elements, and wherein the container includes a vessel having a circular opening at one end thereof for receiving the materials to be stored and which opening is closed off from the ambient with a sealing cover placed therein.

The method of the invention includes the steps of: conically widening the inner bore of the vessel at the opening end thereof to define a conical seating surface; turning the outer peripheral surface of the cover to have a conical surface having the same taper as the taper of the seating surface; turning the upper portion of the outer peripheral surface of the cover to define a cylindrical surface; pressing the cover down onto the conical seating surface to a depth below the rim of the vessel after filling the vessel with the materials to be stored thereby defining an annular groove of wedge-shaped section; joining the cover to the vessel by means of a gas-shielded arc weld while maintaining an equalization of pressure between the interior of the container and the ambient, the flow of shielding gas being directed from above into the annular gap of wedge-shaped section and, the weld formed in this manner including: a first portion defining an annular bevel weld filling in the annular groove of wedge-shaped section; and, a second portion defining an annular fillet weld disposed in the fillet defined by the top peripheral edge surface of the cover and the remainder of the conical seating surface of the vessel above the bevel weld; and discontinuing the maintenance of the equalization of pressure after completing the welding step.

With the aid of the invention, containers for receiving material which is radioactive or dangerous to living organisms can, after they have been filled, be safely sealed with a high impermeability to gas and again be tested as to the integrity of the seal. The invention permits the utilization of remotely-controlled programmed robots and automatic welding equipment to produce connections of a reproducible high quality.

BRIEF DESCRIPTION OF THE DRAWING

The invention will now be described with reference to the drawing wherein.

DESCRIPTION OF THE PREFERRED EMBODIMENTS OF THE INVENTION

Figure 1:
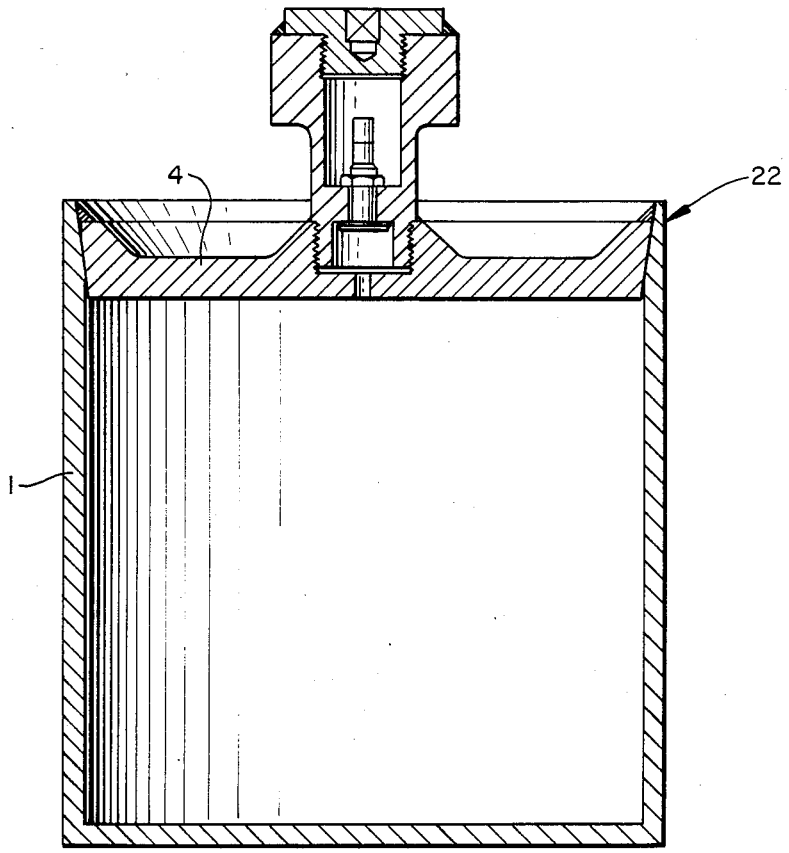
FIG. 1 is a side elevation view, in section, of a container according to the invention.

Referring to the drawing, FIG. 1 shows a metal container 22 of the invention. The container 22 includes a vessel 1 and a cover 4 seated in the open end of the vessel.

Figure 2:
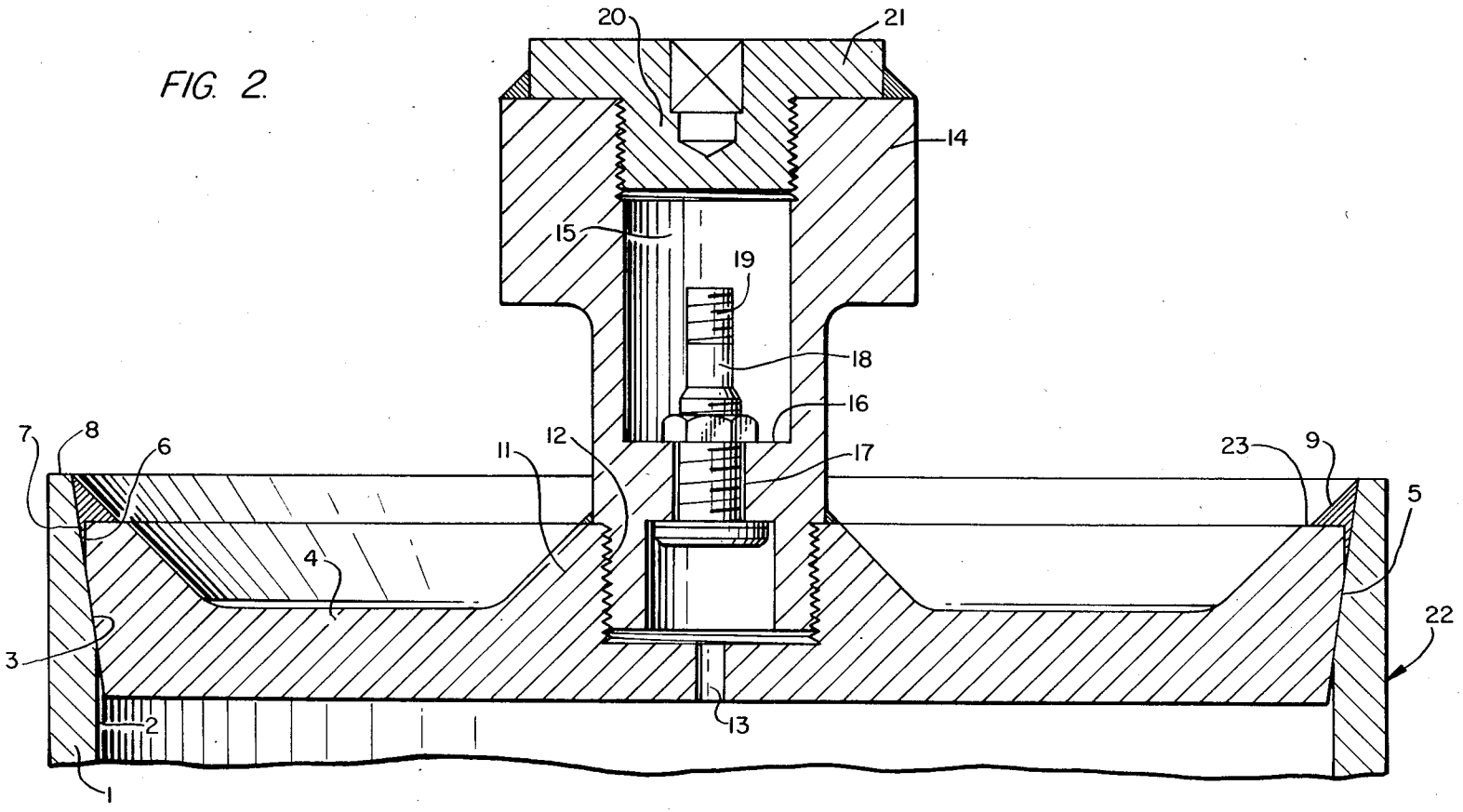
FIG. 2 is a side elevation view, in section, of the upper portion of the container of FIG. 1.

FIG. 2 is an enlarged view of the upper portion of the container 22 and shows that the inner bore 2 of the vessel 1 is conically widened at its upper end to define a conical seating surface 3. The sealing cover 4 is pressed into the vessel at its open end and lies with its conical outer peripheral surface 5 on the seating surface 3 of the inner bore 2 of the vessel 1. The upper portion of the outer peripheral surface of the sealing cover 4 has a cylindrically beveled surface 6 so that a wedge shaped gap 7 is formed between the inner wall of the vessel 1 and the sealing cover 4. The sealing cover 4 is so positioned in the vessel 1 that its upper edge 23 lies beneath the rim 8 of the vessel and is tightly welded with the vessel wall by a fillet weld 9 at the open end of the vessel 1.

A protrusion 11 is centrally located on the outer side of the cover 4 and is provided with a threaded bore 12. Beneath the bore 12, the cover 4 is penetrated by a connecting bore 13 of smaller diameter.

A cover knob 14 threadably engages the threaded bore 12 of the protrusion 11 of the cover 4. The knob 14 is provided with a recess 15 in the form of a blind bore lying along the longitudal axis of the knob 14. The knob 14 and protrusion 11 are welded to each other at their connecting joint.

The base 16 of the recess 15 is provided with a centrally disposed through-bore 17 through which the valve body 18 of a check valve extends. The valve body 18 is secured in the manner of a bolt to the base 16 of the recess 15. The valve body 18 and its pressure-means connection 19 projects into the recess 15 of the knob 14, the recess 15 defining a protective chamber for the valve.

The recess 15 is closed at its upper end with a plug 20 which threadably engages the knob. The plug 20 lies with its flange 21 on the knob 14. The rim of the flange 21 and the knob 14 are welded to each other.

After the vessel 1 is filled to a specific level, the sealing cover 4 having a conical outer peripheral surface is guided into its open, conical end and pressed therein. The conical seating surface 3 of the vessel 1 has the same taper as the conical outer peripheral surface of the cover.

By pressing the conical sealing cover 4 into the inner cone 3 of the vessel 1, a radial force is exerted on the vessel wall. At the region of the conical seating surface 3, the wall of the vessel 1 is of a thickness which permits the wall to respond to this radial force and fit approximately evenly to the peripheral outer surface 5 of the sealing cover 4 thereby contributing to an improvement in the seal therebetween.

The sealing cover 4 is pressed into the vessel cone 3 so deep that sufficient space remains between the upper sealing cover edge 23 and the vessel rim 8 to accommodate a fillet weld 9.

While the valve 18 is held open, the sealing cover 4 can be joined to the vessel 1 by means of a gas-shielded arc-welding process.

The stream of shielding gas is directed into the wedge-shaped gap 7 between the vessel wall and the sealing cover 4.

Subsequently, a suitable test gas is injected into the space formed by the sealing cover 4 and the vessel 1 via the valve 18. With the aid of this gas, the impermeability of the sealing of this space can be tested and this test can be repeated. During the test, the gas pressure in the container is measured via the valve 18. If the gas pressure is too low or if the measured value falls off, this indicates that a leak of the closed off container is present so that appropriate measures can be taken to remove the leak.

The integrity of the seal of the closed off container can be tested and this test can be repeated. If the test is satisfactory, the plug 20 on the cover knob 14 is welded tight in order to tightly close off the valve chamber 15. In the event that a new test is to be made after a large amount of time has passed since the container has been sealed off, it is merely necessary to destroy the weld-seam of the plug 20. Then either a new test gas can be applied or a test of the pressure within the container can be made.

Other modifications and variations to the embodiments described will now be apparent to those skilled in the art. However, the aforesaid embodiments are not to be construed as limiting the breadth of the invention. The full scope and extent of the present contribution can only be appreciated in view of the appended claims.

What is claimed is:

1. A container for receiving and safely storing radioactive materials or other materials damaging to living organisms such as vitrified radioactive fission products or irradiated nuclear reactor fuel elements, the container comprising:

a vessel for receiving the materials to be stored therein, the vessel including a base and a wall extending upwardly from said base, said wall terminating in a circular rim defining the opening of the vessel through which the materials to be stored therein are passed, said wall defining an inner wall surface having an upper surface portion diverging outwardly away from the remainder of said inner wall surface to define a conical seating surface communicating with said rim;

a sealing cover pressable into said vessel thereby exerting a radial force thereagainst and closing off the latter from the ambient, said cover having a massive unyielding peripheral portion defining an outer peripheral surface for engaging said vessel seating surface when the sealing cover is pressed into said vessel, said peripheral surface converging toward the interior of said vessel to define a conical surface having a taper corresponding to the taper of said vessel seating surface whereby said conical surfaces coact to provide a seal fit between said vessel and said sealing cover;

said wall of said vessel having a thickness at said conical sealing surface thereof selected to permit said wall to respond to said radial force to fit approximately evenly to said conical surface of said cover thereby contributing to the integrity of said seal fit;

said conical surface being smooth and uninterrupted so as to unrestrictingly receive said cover thereagainst as the latter is pressed downwardly into said vessel so as to permit development of said radial force fit; and, a weld joining said sealing cover to said vessel, said weld being in the form of a fused-mass joint extending around the entire periphery of said sealing cover.

2. The container of claim 1 wherein: said sealing cover has an upper edge communicating with said sealing cover peripheral surface, said upper edge being disposed beneath said rim; and said weld being a fillet weld mutually joining said rim and said upper edge.

3. The container of claims 1 or 2 wherein: the upper portion of said cover outer peripheral surface diverges away from the remainder thereof to define a cylindrical surface, said cylindrical surface and said conical seating surface conjointly defining an annular groove of wedge-shaped section for receiving at least a portion of said weld therein.

4. The container of claim 3 comprising: a valve mounted on the sealing cover so as to be accessible outside of the container, said valve communicating with the interior of said vessel and having test-gas connection means connectable to a source of test gas.

5. The container of claim 4 wherein: said sealing cover has a projection extending upwardly therefrom, said projection having a recess formed therein for accommodating said valve.

6. The container of claim 5 comprising: a plug engageable with said projection for closing off said recess.

7. The container of claim 5, said projection having a cylindrical configuration and having a thread formed on the lower end thereof; and, said sealing cover having a central threaded bore formed therein for threadably engaging said cylindrical projection.

8. The container of claim 7 wherein: the projection is further configured as a knob.

9. A container for receiving and safely storing radioactive materials or other materials damaging to living organisms such as vitrified radioactive fission products or irradiated nuclear reactor fuel elements, the container comprising:

a vessel for receiving the materials to be stored therein, the vessel including a base and a wall extending upwardly from said base, said wall terminating in a circular rim defining the opening of the vessel through which the materials to be stored therein are passed, said wall defining an inner wall surface having an upper surface portion diverging outwardly away from the remainder of said inner wall surface to define a conical seating surface communicating with said rim;

a sealing cover pressable into said vessel thereby exerting a radial force thereagainst and closing off the latter from the ambient, said cover having a massive unyielding peripheral portion defining an outer peripheral surface for engaging said vessel seating surface when the sealing cover is pressed into said vessel, said peripheral surface converging toward the interior of said vessel to define a conical surface having a taper corresponding to the taper of said vessel seating surface whereby said conical surfaces coact to provide a seal fit between said vessel and said sealing cover;

said wall of said vessel having a thickness at said conical sealing surface thereof selected to permit said wall to respond to said radial force to fit approximately evenly to said conical surface of said cover thereby contributing to the integrity of said seal fit;

said conical surface being smooth and uninterrupted so as to unrestrictingly receive said cover thereagainst as the latter is pressed downwardly into said vessel so as to permit development of said radial force fit;

the upper portion of said cover outer peripheral surface diverging away from the remainder thereof to define a cylindrical surface, said cylindrical surface and said conical seating surface conjointly defining an annular groove of wedge-shaped section for receiving a bevel weld therein;

said cover further having a top peripheral edge contiguous with said cylindrical surface thereof; and said top peripheral edge and the portion of said conical seating surface of said vessel above the level of said top peripheral edge conjointly defining an annular fillet for receiving a fillet weld therein.

10. The container of claim 9 comprising: weld means for joining said cover to said vessel about the periphery of said cover, said weld means including:

a first portion defining an annular bevel weld filling in said annular groove of wedge-shaped section; and, a second portion defining an annular fillet weld disposed in said fillet conjointly defined by said top peripheral edge of said cover and the remainder of said conical seating surface of said vessel above said bevel weld.

11. A container for receiving and safely storing radioactive materials or other materials damaging to living organisms such as vitrified radioactive fission products or irradiated nuclear reactor fuel elements, the container comprising:

a vessel for receiving the materials to be stored therein, the vessel including a base and a wall extending upwardly from said base, said wall terminating in a circular rim defining the opening of the vessel through which the materials to be stored therein are passed, said wall defining an inner wall surface having an upper surface portion diverging outwardly away from the remainder of said inner wall surface to define a conical seating surface communicating with said rim;

a sealing cover pressable into said vessel thereby exerting a radial force thereagainst and closing off the latter from the ambient, said cover having a massive unyielding peripheral portion defining an outer peripheral surface for engaging said vessel seating surface when the sealing cover is pressed into said vessel, said peripheral surface converging toward the interior of said vessel to define a conical surface having a taper corresponding to the taper of said vessel seating surface whereby said conical surfaces coact to provide a seal fit between said vessel and said sealing cover;

said wall of said vessel having a thickness at said conical seating surface thereof selected to permit said wall to respond to said radial force to fit approximately evenly to said conical surface of said cover thereby contributing to the integrity of said seal fit;

said conical surface being smooth and uninterrupted so as to unrestrictingly receive said cover thereagainst as the latter is pressed downwardly into said vessel so as to permit development of said radial force fit;

the upper portion of said cover outer peripheral surface diverging away from the remainder thereof to define a cylindrical surface, said cylindrical surface and said conical seating surface conjointly defining an annular groove of wedge-shaped section;

said cover further having a top peripheral edge contiguous with said cylindrical surface thereof; and said top peripheral edge and the portion of said conical seating surface of said vessel above the level of said top peripheral edge conjointly defining an annular fillet; and, weld means for joining said cover to said vessel about the periphery of said cover, said weld means including:

a first portion defining an annular bevel weld filling in said annular groove of said wedge-shaped section; and, a second portion defining an annular fillet weld disposed in said fillet conjointly defined by said top peripheral edge of said cover and the remainder of said conical seating surface of said vessel above said bevel weld.

12. A method for tightly sealing a container for receiving and safely storing radioactive materials or other materials damaging to living organisms such as vitrified radioactive fission products or irradiated nuclear reactor fuel elements, the container including a vessel having a circular opening and a cover seated in said opening, the method including the steps of:

conically widening the inner bore of the vessel at the end thereof at said opening to define a clear uninterrupted conical seating surface;

turning the outer peripheral surface of the cover to have a conical surface having the same taper as the taper of said seating surface;

turning the upper portion of said outer peripheral surface to define a cylindrical surface;

pressing said cover down onto said conical seating surface to exert a radial force thereagainst so as to cause said wall to respond and fit approximately evenly to said conical surface of said cover thereby contributing to the integrity of said seal fit;

said cover being pressed downwardly to a depth below the rim of said vessel after filling said vessel with the materials to be stored thereby defining an annular groove of wedge-shaped section;

joining the cover to said vessel by means of a gas-shielded arc weld while maintaining an equalization of pressure between the interior of the container and the ambient, the flow of shielding gas being directed from above into the annular gap of wedge-shaped section and the weld having a first portion defining an annular bevel weld filling in said annular groove of wedge-shaped section; and, a second portion defining an annular fillet weld disposed in the fillet defined by the top peripheral edge surface of the cover and the remainder of the conical seating surface of the vessel above the bevel weld; and, discontinuing the maintenance of said equalization of pressure after completing the welding step.

* * * * *